US005625997A

United States Patent [19]

Callahan et al.

[11] Patent Number: 5,625,997

[45] Date of Patent: May 6, 1997

[54] COMPOSITE BEAM

[76] Inventors: Robert M. Callahan, 270 White Oak Dr., Blue Ridge, Va. 24064; Ronald B. Shiflett, Rte. 2, Box 562, Goodview, Va. 24095

[21] Appl. No.: 415,945

[22] Filed: Apr. 3, 1995

Related U.S. Application Data

[63] Continuation-in-part of Ser. No. 175,605, Dec. 30, 1993, abandoned, and a continuation-in-part of Ser. No. 204,524, Mar. 1, 1994, abandoned.

[51] Int. Cl.[6] ..... E04C 3/292

[52] U.S. Cl. ..... 52/737.3; 52/731.1; 52/731.5; 52/737.6

[58] Field of Search ..... 52/241, 243, 262, 52/264, 293.3, 299, 348, 366, 376, 479, 481.1, 481.2, 483.1, 632, 656.1, 656.2, 702, 730.1, 730.4, 731.1, 731.2, 731.3, 731.4, 731.5, 732.1, 737.3, 737.6

[56] References Cited

U.S. PATENT DOCUMENTS

| | | | |
|---|---|---|---|
| 157,920 | 12/1874 | Manes | 52/737.3 |
| 320,079 | 6/1885 | Martin | 52/376 X |
| 537,505 | 4/1895 | Van Dorn | 52/702 X |
| 3,945,167 | 3/1976 | Wendt | 52/731.3 X |
| 4,001,993 | 1/1977 | Daniels | 52/376 |
| 4,239,122 | 12/1980 | Klein | 52/737.3 X |
| 4,272,073 | 6/1981 | Grosser et al. | 52/732.1 X |
| 4,793,113 | 12/1988 | Bodnar | 52/481.1 |
| 5,210,990 | 5/1993 | Kirk, Jr. | 52/664 |

FOREIGN PATENT DOCUMENTS

| | | | |
|---|---|---|---|
| 649653 | 12/1962 | Italy | 52/731.2 |

OTHER PUBLICATIONS

Product Advertisement For HL Stud Corporation, p. 19, The Virginia Builder, Official Publication of The Home Builder's Association of VA, Published By The Mid-Atlantic Trade Exposition, Inc, Jan-Feb. '94 Issue.

*Primary Examiner*—Carl D. Friedman
*Assistant Examiner*—Kevin D. Wilkens
*Attorney, Agent, or Firm*—Stephen R. Greiner

[57] ABSTRACT

A composite beam including an elongated metal shell and a pierceable insert contained within at least one end of the elongated metal shell.

7 Claims, 2 Drawing Sheets

COMPOSITE BEAM

This application is a continuation-in-part of the application, Ser. No. 08/175,605, filed Dec. 30, 1993, now abandoned and a continuation-in-part of the application, Ser. No. 08/204,524, filed Mar. 1, 1994 now abandoned.

FIELD OF THE INVENTION

The present invention relates generally to static structures and, more particularly, to a composite beam including a pierceable nonmetal component for retaining a penetrating fastener.

BACKGROUND OF THE INVENTION

Residential home builders are confronted with significant challenges today in offering high quality construction at competitive prices. New design trends as well as fluctuations in lumber and labor costs often conspire against home builders in realizing a profit for their efforts. In response to marketplace uncertainties, then, steel framed construction is slowly emerging as the preferable way to build a home.

More architects are now specifying steel framing for residential structures than in the past. In fact, it has been reported that the number of steel framed homes constructed between the years 1979 to 1992 increased by more than 300 percent. At present, numerous builders across North America are utilizing steel framed construction in townhouses, apartments and single family dwellings.

Residential builders are attracted to the strength, termite resistance and dimensional stability of steel. Those generally familiar with the steel materials being used in modern residential construction are also aware of their relatively light weight and ease of handling. The variety of steel dimensions and thicknesses has also grown beyond that of standard lumber, thus architects can now exhibit greater creativity in the design of residential buildings. Homes with larger open spaces, longer floor spans and higher walls are the result of this combined creative effort.

Homes constructed with steel frames have proven to be more durable than those framed with wood. In areas vulnerable to hurricanes or earthquakes, they are better able to withstand induced loads. Further, as steel is non-combustible, homes constructed from steel readily comply with local codes and fire regulations. Because it is termite-proof, pesticide treatments are also unnecessary. Thus, health experts recommend steel framing for chemically sensitive home buyers seeking the best possible interior air quality.

Most residential steel framing is assembled using the "stick-built" construction method. Stick-built construction utilizing steel components is similar to that involving wood. Layout and assembly are the same except for one crucial difference, steel components are screwed together rather than quickly nailed as with wood. Thus, some residential builders have been hesitant to utilize steel as construction generally proceeds at a somewhat slower pace and retraining of framing crews, accustomed conventional wood framing methods, is required. A need, therefore, exists for a lightweight metallic beam preserving the advantages of conventional wood framing methods.

SUMMARY OF THE INVENTION

In view of the problems associated with steel frame construction at the present time, it is a principal object of the invention to provide a lightweight composite beam including an elongated metal shell of C-shaped cross section having a pierceable insert contained within at least one end of the elongated metal shell for receiving a penetrating fastener such as a nail. The opposing ends of the elongated metal shell define substantially planar abutment surfaces for positioning adjacent a support such as the sole or top plate in a wall frame.

It is another object of the invention to provide a composite beam of the type described with a pierceable insert comprising a wooden block having an engagement surface flush with the abutment surface of the elongated metal shell for bearing wall loads. An L-shaped bracket is also provided to serve as an abutment for the pierceable insert thereby preventing longitudinal movement of the pierceable insert within the elongated metal shell.

It is a further object of the invention to provide a composite beam having an electrically insulated hole or bore therein for the passage of one or more utility conduits.

Still another object of the invention is to provide a strengthened beam having a pair of elongated metal shells of C-shaped cross section joined in side-by-side fashion. Pierceable inserts are provided within at least one end of the strengthened beam for receiving a penetrating fastener such as a nail. Joists may be attached to the strengthened beam with the provision of metallic joist hangers on said beam.

It is an object of the invention to provide improved elements and arrangements thereof in a composite beam for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENTS

Figure 1:
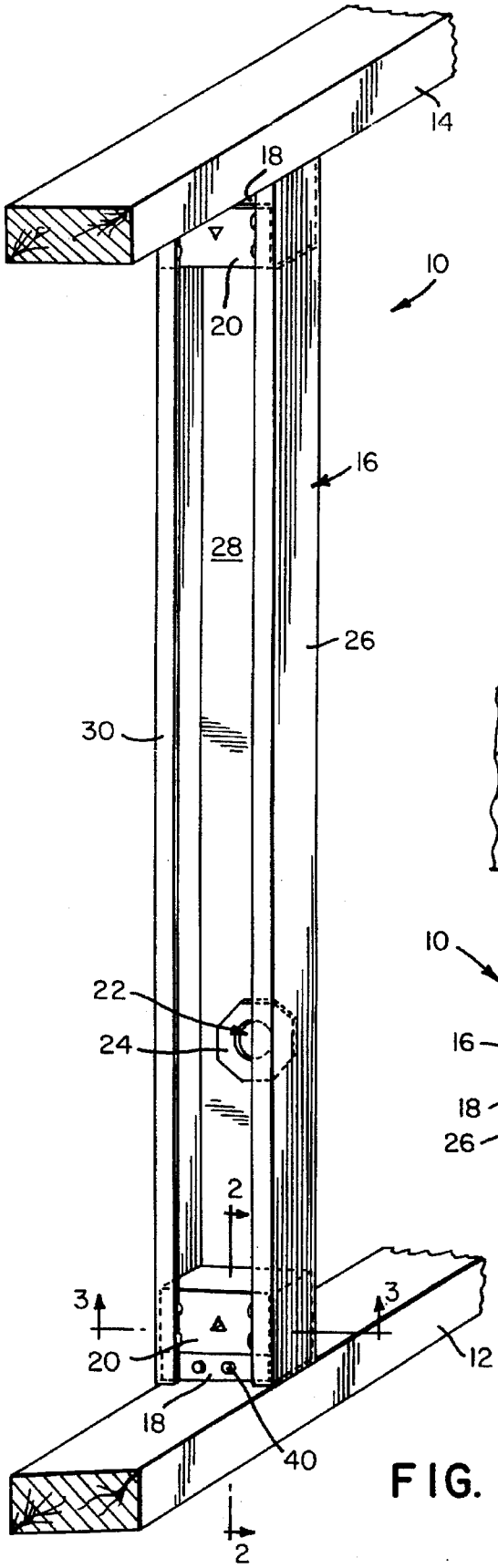
FIG. 1 is a perspective view of a composite beam in accordance with the present invention.

Referring now to FIG. 1 of the drawings, a composite beam 10 in accordance with the present invention is shown, for example, in use as a stud in the framework of a wall. The beam 10 extends vertically between a sole plate 12 and a top plate 14 fabricated from construction grade lumber cut to suitable dimensions, e.g., a nominal 2×4 inches. Although only one beam 10 is illustrated in FIG. 1, it should be understood that additional beams 10 are typically employed in the assembly of a completed wall frame. Multiple beams 10, then, would usually be laterally spaced between the plates 12 and 14 a short distance from one another in a typical wall frame, usually on the order of 16 to 24 inches apart depending on anticipated structural loads.

Figure 2:
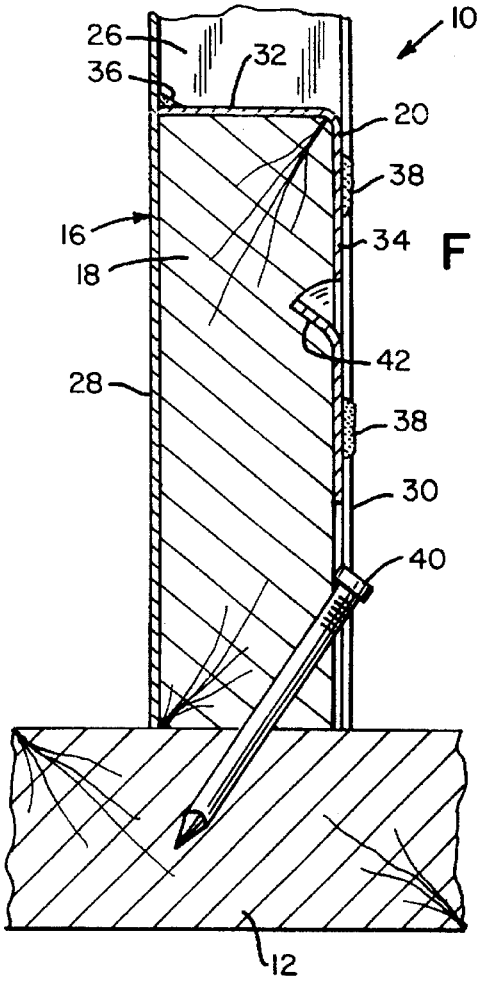
FIG. 2 is a cross-sectional view taken along line 2—2 of FIG. 1.
Figure 3:
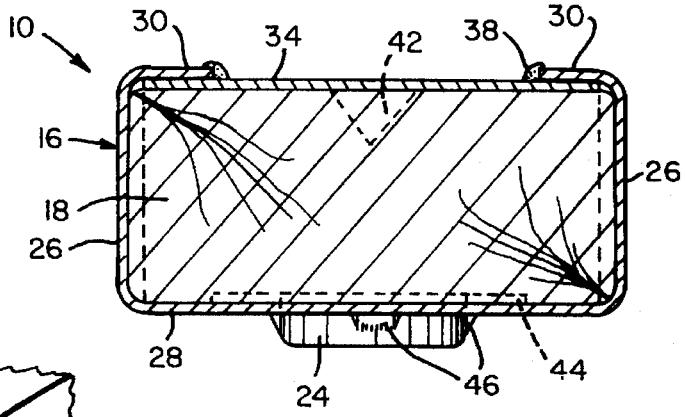
FIG. 3 is a cross-sectional view taken along line 3—3 of FIG. 1.

With particular reference to FIGS. 2 and 3, the beam 10 may be seen to be provided with a generally rectangular cross-sectional configuration. The preferred beam 10 includes an elongated metal shell 16 of C-shaped cross section carrying and containing a pierceable insert 18 within each of its ends. A pair of L-shaped brackets 20 closely fitted within the metal shell 16 serve as retainers and abutments for the inserts 18 by holding each insert within the metal shell 16 and bearing the pressure placed upon each insert during use. In the beam 10, between the L-shaped brackets 20, are one or more holes 22 preferably lined with an electrical insulator 24 preferably molded from plastic for the passage of utility conduits through the beam 10.

The metal shell 16 is conventionally formed by rolling or bending a thin, rectangular strip of sheet metal, comprising galvanized steel or any other suitable metal composition, into a C-shape of desired dimensions. As shown, the finished shell 16 includes a pair of opposing side walls 26 extending at right angles from an intermediate wall 28. A pair of inwardly directed flanges 30 are rolled or bent into position, substantially parallel to the intermediate wall 28, from the free ends of the side walls 26 for improving the stiffness of the shell 16 and assisting in the retention of the pierceable inserts 18 within the ends thereof. The respective ends of the intermediate wall 28, the side walls 26 and the flanges 30 define a substantially planar abutment surface at each end of the elongated shell 16 for positioning closely adjacent a substantially planar support such as sole plate 12 or top plate 14.

The pierceable inserts 18 have a generally rectangular cross-sectional configuration sized to closely engage the side and intermediate walls 26 and 28 of the shell 16. Preferably, the pierceable inserts 18 are provided with a length of 4 to 12 inches so as to fully receive a fastener driven longitudinally therein rather than obliquely as shown in FIG. 2. As it is intended that the beam 10 obtain its principal strength from the metal shell 16, any material adapted to receive and retain therein the shaft of a nail, screw, staple or fastener of any character can be used in connection with the pierceable inserts 18. In this regard, the pierceable inserts 18 may be formed, by way of example only, from a wooden block, consolidated wood pulp or plastic. Preferably, however, the pierceable inserts 18 include an engagement surface positioned flush with the abutment surface at the end of the elongated metal shell 16 for bearing some portion of the wall loads.

Preferably, the pair of L-shaped brackets 20 closely fitted within the metal shell 16 retain each of the pierceable inserts 18 in place within the opposing ends of the metal shell 16. With continuing reference to FIGS. 2 and 3, a preferred bracket 20 may be seen to include a thin, rectangular sheet of galvanized steel, or other suitable metal, bent at a right angle so as to form integral, lateral and longitudinal plates 32 and 34 of appropriate dimensions. The lateral plate 32 is positioned within a plane normal to the longitudinal axis of the metal shell 16 and traverses the space between the intermediate wall 28 and flanges 30 thereof. One or more welds, as at 36, secure the lateral plate 32 to the intermediate wall 28 of the metal shell 16. The longitudinal plate 34, on the other hand, closely engages the interior surface of the opposing flanges 30 and is secured by a plurality of welds 38 thereto.

As shown, the longitudinal plate 34 is provided with a length somewhat shorter than that of the pierceable insert 18 so as to leave a portion of the pierceable insert 18 exposed for the reception of one or more nails 40 or other fasteners used, for example, in fastening the beam 10 to sole plate 12. It should be understood that it is not necessary that the nailing surface thus formed be within the exterior boundaries of the metal shell 16 as shown. By suitably shaping the pierceable insert 18 the nailing surface may be made flush with the exterior boundaries of the metal shell 16 or made to project outwardly beyond it in any desired fashion.

To retain the pierceable insert 18 within the metal shell 16 after assembly, the longitudinal plate 34 is preferably provided with a tab 42 which extends into the pierceable insert a short distance. The tab 42 is preferably formed in the center of the longitudinal plate 34 by piercing or perforating such with a suitable punch. With the insert 18 preferably serving as a support or backing to the longitudinal plate 34 during the perforating operation, the tab 42 thus formed may be immediately received within the insert 18 without the necessity of further tooling. As shown, the preferred tab 42 has a triangular outline whose free end or apex is directed toward the lateral plate 32 so as to further strengthen the connection between the pierceable insert 18 and bracket 20.

The preferred beam 10 includes at least one hole 22 for the installation and passage of utility lines horizontally therethrough. Preferably, such holes 22 are disposed within the intermediate wall 28 of the metal shell 16 adjacent the ends thereof for ready access by an electrician or plumber. As shown, the hole 22 is lined with a well-known plastic insulator 24 held snugly in place by the action of a peripheral flange 44 on one side thereof and a plurality of integral clips 46 on the other.

Figure 4:
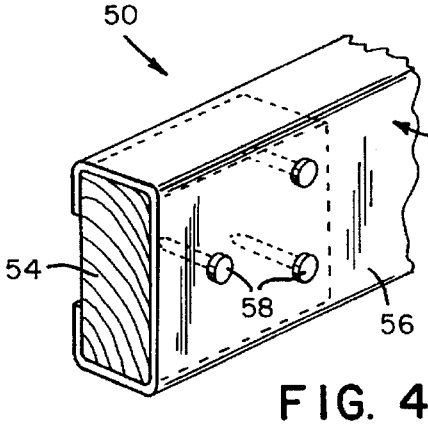
FIG. 4 is a perspective view of a portion of an alternative composite beam in accordance with the present invention.
Figure 5:
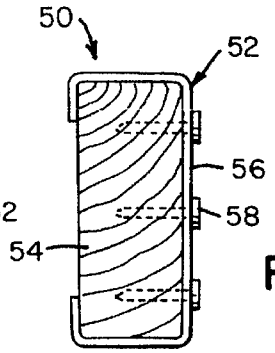
FIG. 5 is a side elevational view of the composite beam of FIG. 4.

Referring now to FIGS. 4 and 5, a simplified beam 50 in accordance with the present invention is illustrated. Preferably, the beam 50 comprises an elongated metal shell 52 fabricated from sheet metal formed into a C-shape and carries a pierceable insert 54 at each of its ends. The intermediate wall 56 of the shell 52 is provided with holes through which nails 58 may be driven to retain the insert 54 in place. Of course, threaded fasteners shown) may be substituted for the nails 54 if desired.

Figure 6:
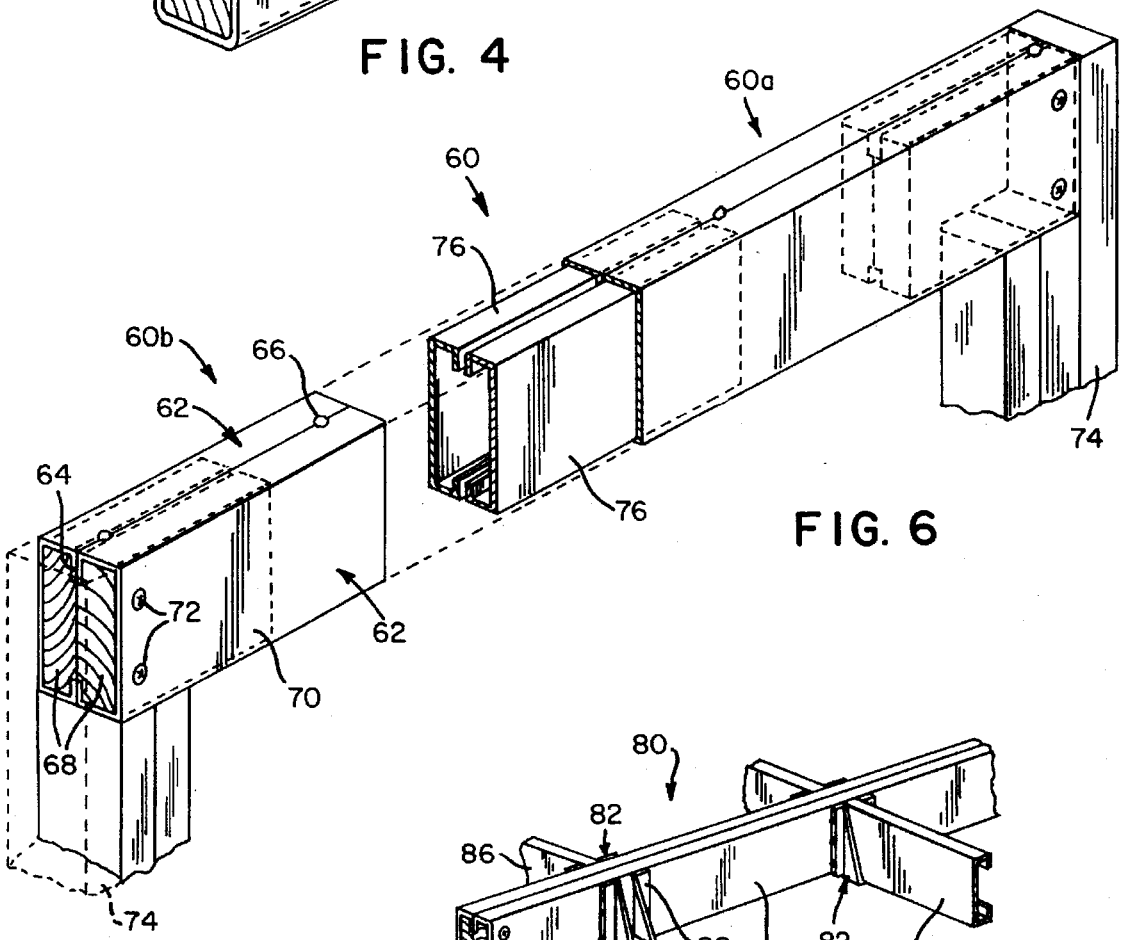
FIG. 6 is a perspective view of a second alternative composite beam in accordance with the present invention.

Instead of making the beam of the present invention in one part, it may be formed in two parts for use in headers and other applications where maximum load bearing strength is required. As shown in FIG. 6, then, a strengthened beam 60 is provided with a pair of C-shaped, metal shells 62 having their respective flanges 64 positioned in abutting relationship and welded together, as at 66, along the resulting top and bottom seams. It should be apparent that, the abutting flanges 64 enhance the stiffness of the beam 60.

A pierceable insert 68 is positioned within the opposing ends of each metal shell 62. A plurality of holes provided in the intermediate wall 70 of each metal shell 62 permit screws 72 or other suitable fasteners to be driven into an adjacent pierceable insert 68 to affix such within the beam 60. As shown, suitable recesses formed in each pierceable insert 68 accommodate the flanges 64 and permit the adjacent pair of pierceable inserts 68 at each end of the beam 60 to contact one another for increased rigidity. This contact surface also assures a user that a fastener driven through one of the stabilizing studs 74 will enter at least one of the pierceable inserts 68 and assist in retaining the beam 60 in a desired location.

Where a relatively long span is to be crossed by a beam 60, such may be formed from two or more segments **60*a*** and

60*b* of any desired length which may be transported to the construction site with relative ease. Thus, in FIG. 6, a pair of close-fitting, C-shaped metal brackets 76 are shown to be fastened to the end of one segment 60*a* and, upon extended the brackets 76 within the other segment 60*b*, may be fastened to the other segment 60*b*. Fastening of the brackets 76 to the segments 60*a* and 60*b* may be accomplished by any suitable means including: welds, rivets and threaded fasteners. The brackets 76 may be of any desired length and may, in fact, be sized to contact pierceable inserts 68 at each of its ends.

Figure 7:
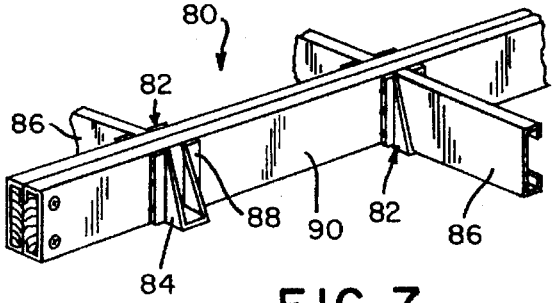
FIG. 7 is a perspective view of a portion of a third alternative composite beam in accordance with the present invention.

It is common practice in the construction of residential buildings to form a floor or ceiling with a main central beam and a series of lateral joists extending perpendicularly therefrom. Referring now to FIG. 7, a strengthened beam 80, like that illustrated in FIG. 6, is provided with a plurality of joist hangers 82 on opposite sides thereof for rapidly constructing a floor or ceiling. Preferably, each joist hanger 82 is formed of folded sheet metal and includes a U-shaped portion 84, adapted to closely receive a joist 86, having a pair of laterally extending braces 88 extending therefrom for attachment to the intermediate wall 90 of beam 80 by welding at the usual 16 or 24 inch spacing.

Once the beam 80 is suitably positioned in a given building structure, the ends of the joists 86 are fitted within joist hangers 82. Although the joists 86 may be formed of wood or any other material, for strength, the joists 86 are preferably constructed in the manner of any of the beams described hereinabove with reference to FIGS. 1–6. It is of note, however, that a joist 86 positioned within a close-fitting joist hanger 82 will remain fixed therein by gravity alone. Thus, the use of penetrating fasteners in conjunction with the pierceable inserts carried in the joists 86 would probably not be required for this particular application of the instant invention.

From the foregoing, it should be apparent that the present invention provides the principal benefits of steel framing while preserving the advantages of conventional construction methods utilizing wood. It should be noted also that the beams provided by the present invention are lighter in weight than conventional wooden counterparts of similar load bearing capability. Thus, with the present invention, residential structures incorporating the latest architectural trends can be constructed with relative ease and minimal cost.

While the invention has been described with a high degree of particularity, it will be appreciated by those skilled in the art that numerous modifications and substitutions may be made thereto. Therefore, it is to be understood that the present invention is not limited to the several embodiments described above, but encompasses any and all embodiments within the scope of the following claims.

We claim:

1. A composite beam, comprising:

an elongated shell having a C-shaped cross section, said elongated shell including:

an intermediate wall;

a pair of side walls integral with said intermediate wall and extending at right angles therefrom;

a pair of flanges integral with said pair of side walls and extending at right angles therefrom in a common plane parallel to said intermediate wall; and, the respective ends of said intermediate wall, said pair of side walls and said pair of flanges defining a substantially planar abutment surface at each end of said elongated shell;

a pierceable insert contained within each end of said elongated shell; and, an L-shaped bracket contained within each end of said elongated shell serving as an abutment for one said pierceable insert.

2. The composite beam according to claim 1 wherein each said L-shaped bracket includes a longitudinal plate secured to at least one of said pair of flanges and a lateral plate integral with said longitudinal plate and extending at a right angle therefrom thereby prevent longitudinal movement of each said pierceable insert in said elongated shell.

3. The composite beam according to claim 2 wherein the free end of each said lateral plate abuts said intermediate wall of said elongated shell.

4. The composite beam according to claim 2 wherein each said longitudinal plate has a length shorter than that of each said pierceable insert.

5. The composite beam according to claim 2 wherein each said longitudinal plate includes a tab extending therefrom into each said pierceable insert.

6. A composite beam, comprising:

an elongated metal shell having a C-shaped cross section, said elongated metal shell including:

an intermediate wall;

a pair of side walls integral with said intermediate wall and extending at right angles therefrom;

a pair of flanges integral with said pair of side walls and extending at right angles therefrom in a common plane parallel to said intermediate wall; and, the respective ends of said intermediate wall, said pair of side walls and said pair of flanges defining a substantially planar abutment surface at each end of said elongated metal shell;

a pierceable insert contained within at least one end of said elongated metal shell; and, an L-shaped bracket contained within said elongated metal shell serving as an abutment for said pierceable insert.

7. The composite beam according to claim 6 wherein said L-shaped bracket includes a tab extending therefrom into said pierceable insert.

* * * * *